US005649130A

United States Patent [19]

Nakajima et al.

[11] Patent Number: 5,649,130

[45] Date of Patent: Jul. 15, 1997

[54] CLEANING SHEET, A CLEANING MEMBER AND A CLEANING APPARATUS FOR A FUSER ROLL

[75] Inventors: Masahiro Nakajima; Hiroshi Ito; Hiroshi Tanaka, all of Shiga, Japan

[73] Assignee: Japan Vilene Company, Ltd., Tokyo, Japan

[21] Appl. No.: 694,933

[22] Filed: Aug. 9, 1996

[30] Foreign Application Priority Data

Aug. 11, 1995 [JP] Japan ..... 7-227368

[51] Int. Cl.[6] ..... G03G 15/20; G03G 15/22

[52] U.S. Cl. ..... 399/327

[58] Field of Search ..... 399/327, 320, 399/324–326

[56] References Cited

U.S. PATENT DOCUMENTS 5,218,410 6/1993 Nakabayashi et al. .
5,327,203 7/1994 Rasch et al. .

FOREIGN PATENT DOCUMENTS 3-63683 3/1991 Japan .
3-141383 6/1991 Japan .
5-119688 5/1993 Japan .

*Primary Examiner*—Shuk Lee
*Attorney, Agent, or Firm*—Sughrue, Mion, Zinn, Macpeak & Seas

[57] ABSTRACT

A cleaning sheet for a fuser roll, wherein an average diameter of fibers constituting said cleaning sheet is not more than 14 μm; a layer containing not less than 30% by weight of softening fibers which soften at a temperature higher than an ambient temperature of the fuser roll, but lower than a temperature which is 100° C. higher than a surface temperature of the fuser roll is contained; and the cleaning sheet is bonded with adhesive fibers having a fiber diameter of not more than 20 μm; a cleaning member for a fuser roll, having the above cleaning sheet; a supply shaft around which the cleaning sheet is wound; and a take-up shaft to which one end of the cleaning sheet is fixed; and a cleaning apparatus for a fuser roll, having the above cleaning member; and a pinch member for pressing the cleaning sheet wound off from the supply shaft to a fuser roll and conveying the cleaning sheet to the take-up shaft.

10 Claims, 2 Drawing Sheets

CLEANING SHEET, A CLEANING MEMBER AND A CLEANING APPARATUS FOR A FUSER ROLL

BACKGROUND OF THE INVENTION

1. Field of the Invention

The present invention relates to a cleaning sheet for a fuser roll, a cleaning member for a fuser roll and a cleaning apparatus for a fuser roll.

2. Description of the Related Art

Known cleaning members used for fuser rolls in electronic photography apparatuses such as copying machines, laser beam printers, or facsimiles for fixing toner on a paper sheet or the like include, as shown in FIG. 1, a cleaning sheet 1 comprising a nonwoven fabric which is made of aromatic polyamide fibers fixed by undrawn polyethylene terephthalate fibers and is impregnated with a release agent such as silicone oil; a supply shaft 2 around which the cleaning sheet is wound; and a take-up shaft 3 to which one end of the cleaning sheet 1 is fixed. When the cleaning member is used, the cleaning sheet 1 is wound off from the supply shaft 2. Then, the cleaning sheet is pressed onto a fuser roll 5 with a pinch member 4, and wound up on the take-up shaft 3. As shown in an enlarged view of a portion of the cleaning sheet wound off from the supply shaft 2 (FIG. 4), however, the release agent retained in the cleaning sheet 1 is liberated from the cleaning sheet 1, when the cleaning sheet 1 is wound off from the supply shaft 2. The liberated release agent is liable to accumulate on the cleaning sheet which has not yet been wound off, after it remains at the edges of the cleaning sheet which has not yet been wound off (the "O" portion in FIG. 4). Consequently, it is not possible to apply a sufficient amount of release agent even by pressing the wound off cleaning sheet against the fuser roll. Further, the amount of release agent applied is not constant, and when the amount of the cleaning sheet still wound on the shaft is decreased, a relatively large amount of the release agent is retained in comparison with a small amount of the cleaning sheet, and thus, the release agent often spills over and faints the surrounding areas.

SUMMARY OF THE INVENTION

The object of the present invention is to remedy the problems of the prior art, and to provide a cleaning sheet, a cleaning member and a cleaning apparatus for a fuser roll, which allows stably constant application of a sufficient amount of the release agent, without spilling over of the release agent.

Other objects and advantages will be apparent from the following description.

In accordance with the present invention, there is provided a cleaning sheet for a fuser roll (hereinafter referred to as "cleaning sheet"), wherein an average diameter of fibers constituting said cleaning sheet is not more than 14 μm (14 μm or less); a layer containing not less than 30% by weight (30% by weight or more) of softening fibers which soften at a temperature higher than an ambient temperature of the fuser roll, but lower than a temperature which is 100° C. higher than a surface temperature of said fuser roll is contained; and said cleaning sheet is bonded with adhesive fibers having a fiber diameter of not more than 20 μm (20 μm or less).

Fine fibers having an average fiber diameter of 14 μm or less are used to constitute the cleaning sheet of the present invention, and therefore, fine pores are formed and thus the holding capacity of the release agent is increased. Further, adhesive fibers used for bonding the fibers are also fine fibers having a fiber diameter of 20 μm or less. Therefore, the fine pores clogged with adhesive fibers are decreased and thus, the holding capacity of the release agent is maintained. Furthermore, the bonding sites are preferably dispersed uniformly throughout the entire cleaning sheet, and thus, the cleaning sheet may be wound off from a supply shaft while holding the release agent in the condition similar to the one wherein the release agent is held in the cleaning sheet wound around the supply shaft. Accordingly, the release agent can be stably applied by the cleaning sheet of the present invention, and even when the amount of the cleaning sheet on the supply shaft is decreased, there is no dropping of the release agent. Furthermore, the softening fibers in the cleaning sheet of the present invention are softened and deformed when pressed against the heated fuser roll, and thus the thickness of the cleaning sheet is reduced to squeeze the release agent. Therefore, a sufficient amount of release agent may be applied onto the fuser roll. As above, the cleaning sheet of the present invention possesses advantageously the incompatible properties of the holding capacity of the release agent and the applying property of the release agent.

In accordance with the present invention, there is also provided a cleaning member for a fuser roll, comprising the above-mentioned cleaning sheet; a supply shaft around which said cleaning sheet is wound; and a take-up shaft to which one end of said cleaning sheet is fixed.

The cleaning member of the present invention is designed so that the above-mentioned cleaning sheet containing the release agent is wound around a supply shaft and the other end of the cleaning sheet is fixed to a take-up shaft. Thus, it is possible to stably apply a sufficient amount of the release agent, and there is no dropping of the release agent even when the amount of the cleaning sheet is reduced on the supply shaft.

In accordance with the present invention, there is further provided a cleaning apparatus for a fuser roll, comprising the above-mentioned cleaning member; and a pinch member for pressing the cleaning sheet wound off from the supply shaft to a fuser roll and conveying the cleaning sheet to the take-up shaft.

In accordance with the present invention, there is still further provided a cleaning apparatus for a fuser roll, comprising the above-mentioned cleaning member; a first pinch member for pressing the cleaning sheet wound off from the supply shaft to a fuser roll; a reversing member for turning the cleaning sheet from a contacted side to a fresh side; and a second pinch member for pressing the cleaning sheet from the reversing member to a fuser roll and conveying the cleaning sheet to the take-up shaft.

Thus, it is possible to stably apply a sufficient amount of the release agent, and there is no dropping of the release agent even when the amount of the cleaning sheet is reduced on the supply shaft.

DESCRIPTION OF THE PREFERRED EMBODIMENTS

Figure 1:
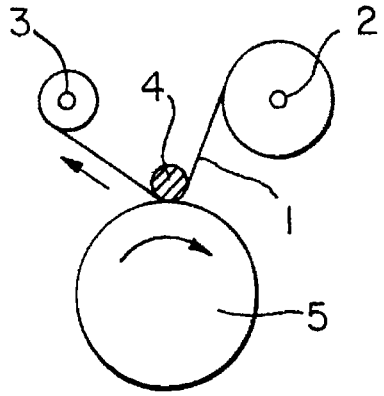
FIG. 1 is a sectional view schematically illustrating one example of a cleaning apparatus.

The cleaning sheet of the present invention is designed to have excellent shape stability even when brought into contact with the fuser roll, by partially or wholly bonding the fiber web with the adhesive fibers. The adhesive fiber which may be used in the present invention has the softening point higher than that of the softening fibers as mentioned below contained in the identical cleaning sheet of the present invention. The whole bonding is preferable, because the cleaning sheet becomes resistant to shrinkage even when brought into contact with the fuser roll, and the release agent is hard to be irregularly applied. The adhesive fibers used have a fiber diameter of preferably 20 μm or less, more preferably 19 μm or less, to minimize clogging of the fine pores in the cleaning sheet and ensure uniform dispersion throughout the cleaning sheet. If a large amount of adhesive fibers which have sufficiently small fiber diameter is used, fine pores are clogged and thus the holding capacity of the release agent is lowered. Thus, the content of the adhesive fibers in the cleaning sheet is preferably 50% by weight or less, more preferably 40% by weight or less. On the contrary, to ensure excellent shape stability of the cleaning sheet, the content of the adhesive fibers in the cleaning sheet is preferably 10% by weight or more, more preferably 20% by weight or more.

Examples of adhesive fibers which may be used in the present invention are those which can maintain their adhesive strength even when brought into contact with fuser rolls, such as undrawn polyethylene terephthalate fibers, undrawn polybutylene terephthalate fibers, undrawn polyphenylene sulfide fibers, and nylon-based undrawn fibers such as 6 nylon and 66 nylon. Of these, undrawn polyethylene terephthalate fibers may be preferably used as the adhesive fibers, because undrawn polyethylene terephthalate fibers have a high melting point of 255° C. and do not lose adhesive strength or result in tearing of the cleaning sheet when contacted with a fuser roll. Further, they also have a relatively low bonding temperature for bonding fiber webs and a wide bonding temperature range, and thus the cleaning sheets may easily be produced. The cross-sectional shape of the adhesive fibers may be a polygonal shape such as triangular or square shape, or it may be an irregular shape such as an alphabetic shape, i.e., a letter X or Y. In such a case, the value calculated for the circular cross-section is used as the fiber diameter.

In the present invention, the softening fibers are used as the constituent fibers of the cleaning sheet. The softening fiber which may be used in the present invention has the softening point lower than that of the adhesive fibers contained in the identical cleaning sheet of the present invention. Thus, the softening fibers are softened and deformed when brought into contact with the fuser roll, and the thickness of the cleaning sheet is reduced to squeeze the release agent. Therefore, a sufficient amount of the release agent can be applied. When the layer containing the softening fibers is brought into direct contact with the fuser roll, the softening fibers are softened and deformed, whereby the area contacting with the fuser roll is widened. Thus, there are provided the additional advantageous effects that the cleaning ability is improved and the damage of the fuser roll is lowered. Therefore, the cleaning sheet of the present invention has preferably the layer containing the softening fibers as a surface layer on at least one side.

The softening fibers used are fibers which have a softening point above an ambient temperature of the fuser roll so as to prevent the fibers from softening and deforming and prevent the release agent from dropping prior to contact with the fuser roll, and at the same time below a temperature 100° C. higher than the surface temperature of the fuser roll so as to allow softening and deformation upon pressed against the fuser roll. More specifically, the surface temperature of a fuser roll is generally between 170° C. and 200° C. and the ambient temperature around the area locating the fuser roll is about 50° C. lower than the surface temperature, i.e., about 120° to 150° C. When the surface temperature of the fuser roll is 170° C., for example, the softening fibers which soften within a range of about 120° C. to about 270° C. are used. When the surface temperature of the fuser roll is 200° C., the softening fibers which soften between about 150° C. and about 300° C. are used. Such softening fibers may be polyamide-based fibers such as 6 nylon fibers or 66 nylon fibers, polyester-based fibers such as dram polyethylene terephthalate fibers or drawn polybutylene terephthalate fibers, acrylic-based fibers, vinylon-based fibers, drawn polyphenylene sulfide fibers, or the like. Of these fibers, drawn polyethylene terephthalate fibers are preferable, because they have a high melting point of about 255° C., and they are hard to be softened and melted at the ambient temperature of the fuser roll.

Figure 6:
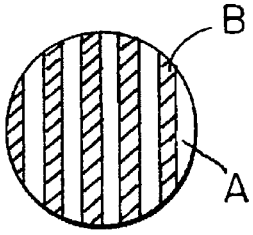
FIG. 6 is a sectional view schematically illustrating another example of a dividable fiber.
Figure 5:
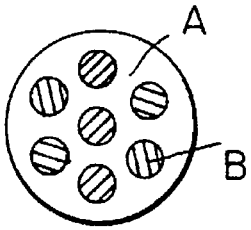
FIG. 5 is a sectional view schematically illustrating one example of a dividable fiber.
Figure 7:
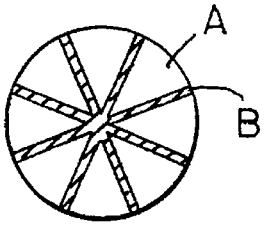
FIG. 7 is a sectional view schematically illustrating still another example of a dividable fiber.
Figure 8:
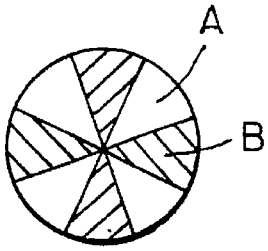
FIG. 8 is a sectional view schematically illustrating still another example of a dividable fiber.

Another preferable softening fibers are, for example, mechanically and/or chemically dividable fibers which consist of two components, i.e., a polyamide-based resin and a polyester-based resin. The extremely fine pores may be formed from polyamide-based ultrafine fibers and a polyester-based ultrafine fibers produced by dividing dividable fibers. Thus, the holding capacity of the release agent is excellent. As the dividable fibers, there may be mentioned, for example, a sea-islands-type fiber having a sectional construction wherein a first component A contains another component B in the form of islands in a sea, as shown in FIG. 5; a multiple bimetal-type fiber having a sectional construction wherein a first component A and a second component B are mutually layered, as shown in FIG. 6; or an orange type fiber having a sectional construction wherein a first component A spreads radially from the vicinity of the fiber axis and is divided into 2 or more sections by another component B, as shown in FIG. 7 or FIG. 8. Of these fibers, multiple bimetal-type fibers and orange type fibers are preferable, because when separated they produce ultrafine fibers with a wedge-shaped cross-sectional construction to allow formation of finer pores. In addition to the above combinations of the resin components constituting the dividable fibers used as the softening fibers, other combinations include, for example, a combination of polyester-based resins and acrylic-based resins, and a combination of polyamide-based resins and polyacrylic-based resins.

The cleaning sheet of the present invention contains the layer containing 30% by weight or more of the softening fibers so as to obtain a good applicability of the release agent. The layer contains preferably 50% by weight or more of the softening fibers. On the other hand, because the layer containing these softening fibers may also contain the adhesive fibers in an amount of preferably 10% by weight or more so as to impart dimensional stability thereto, and therefore the softening fibers are preferably present at 90% by weight or less, and more preferably 80% by weight or less. In the present specification, the softening temperature of the softening fibers means the temperature at which a rapid shrinkage of the softening fibers occurs while a constant load (0.01 g/d or less) is being applied to the fiber to be tested and the temperature is being raised at rate of 1° C./min.

The fiber diameter of the softening fibers is preferably 14 μm or less, more preferably 13 μm or less, so as to facilitate formation of fine pores in the cleaning sheet. The cross-sectional shape of the softening fibers may be a polygonal shape such as triangular or square shape, or it may be an irregular shape such as an alphabetic shape, i.e., a letter X or Y. In such a case, the value calculated for the circular cross-section is used as the fiber diameter.

The cleaning sheet of the present invention preferably contains fibers with a shrinking rate of 2% or less at 200° C. (hereinafter referred to as "low shrinkable fibers"), in addition to the adhesive fibers and softening fibers described above, because their resistance to shrinkage avoids the problems of thickness increase by shrinkage, increased friction resistance, a damage to the fuser roll, shortening of the sheet length due to shrinkage, and shortening of a lifetime, if the cleaning sheet is brought into contact with the fuser roll. The low shrinkable fibers may be fibers composed of resin components such as meta- or para-aromatic polyamides, polyamidimides, polytetrafluoroethylenes, aromatic polyether amides, polybenzimidazoles, polyphenylene sulfide, or the like, or shrinked fibers prepared by shrinking the above-mentioned softening fibers by relaxation through heat treatment. The above fibers may be used alone or in various combinations. Of the fibers as mentioned above, aromatic polyamide fibers may be preferably used for their excellent heat resistance and toner wipeable properties in addition to shrink properties.

The low shrinkable fibers are contained in the cleaning sheet at an amount of preferably 5% by weight or more, more preferably 10% by weight or more, so as to minimize shrinking of the cleaning sheet. On the other hand, they are preferably contained in an amount of 50% by weight or less so that the adhesive fibers and softening fibers can be mixed.

The main purpose to use the low shrinkable fibers is to prevent the cleaning sheet from shrinking. When a layer containing a large amount of low shrinkable fibers is formed in the cleaning sheet, it is possible to take full advantage of the applicability of the release agent by the softening deformation of the softening fibers. That is, when a layer containing 30% by weight or more of the low shrinkable fibers and a layer containing 30% by weight or more of the softening fibers are formed in the cleaning sheet, it is possible to maintain the shape of the cleaning sheet by the layer containing 30% by weight or more of the low shrinkable fibers while also ensuring efficient applying of the release agent by the layer containing 30% by weight or more of the softening fibers. It is particularly suitable for at least either one side of two surface layers to contain 30% by weight or more of aromatic polyamide fibers as the low shrinkable fibers, because such a surface layer improves the toner wipeability. The shrinkage rate used herein indicates the rate of dimensional change upon applying a constant load (0.01 g/d or less) to the fibers to be tested and allowing them to stand in an atmosphere at 200° C. for 20 minutes.

The fiber diameter of the low shrinkable fibers is preferably 14 μm or less,more preferably 13 μm or less, so as to facilitate formation of fine pores in the cleaning sheet. The cross-sectional shape of the low shrinkable fibers may be a polygonal shape such as triangular or square shape, or it may be an irregular shape such as an alphabetic shape, i.e., a letter X or Y. In such a case, the value calculated for the circular cross-section is used as the fiber diameter. If the low shrinkable fibers are aromatic polyamide fibers, a polygonal shape or irregular cross-sectional shape is preferable for excellent wipeability and retention of the toner.

The cleaning sheet of the present invention is made of the fibers described above, and the constituent fibers have an average fiber diameter of 14 μm or less, preferably 13 μm or less, for excellent holding capacity of the release agent. Although the average fiber length of the constituent fibers of the cleaning sheet varies with the method of forming the fiber web, it is preferably between about 1 and 125 mm. The average fiber length is more preferably 25 mm or more, because the fibers are hard to be liberated from the cleaning sheet, and it is more preferably 110 mm or less, because the cleaning sheet with a uniform texture may be obtained. The average fiber diameter according to the present invention is the value calculated from the following formula when the cleaning sheet is constituted from "n" types of fibers (a, b, c . . . n):

$$D = \sum_{x=a}^{n} D_x \cdot L_x/(L_a + L_b + L_c + \ldots + L_n)$$

wherein $\overline{D}$ denotes an average fiber diameter (μm), X denotes a kind of a constituent fiber (a,b,c, . . . n), $D_x$ denotes a diameter (μm) of a constituent fiber X, $L_x$ denotes a quotient given by dividing a percentage of a weight of a constituent fiber X in a cleaning sheet by a fineness (denier) of the constituent fiber X.

For example, when the sheet is constituted from 3 types of fibers, the fiber a, the fiber b and the fiber c, the value calculated from the following formula is the average fiber diameter:

$$\overline{D} = D_a \cdot L_a/(L_a + L_b + + L_c) + D_b \cdot L_b/(L_a + L_b + L_c) \ldots + D_c \cdot L_c/(L_a + L_b + L_c)$$

After the fiber web is formed using the fibers as described above, the fiber web is bonded with the adhesive fibers to form the cleaning sheet. The method of forming the fiber web may be a dry process such as a carding process or an air-laid process, or a wet process. The cleaning sheet preferably contains a cross-laid fiber web prepared by crossing a parallel fiber web by a carding process, against the web direction by a cross layer or the like, because the cross-laid fiber web provides greater strength in the warp and weft directions. When the cleaning sheet containing a cross-laid fiber web is brought into contact with the fuser roll, the toner may be wiped in a linear manner. That is, such a cleaning sheet has an excellent cleaning property. Therefore, it is preferable to prepare a cross-laid fiber web from a layer containing the aromatic polyamide fibers.

When two fiber webs are laminated, namely, a first fiber web containing 30% by weight or more of the softening fibers as one surface layer and a second fiber web containing 30% by weight or more of the low shrinkable fibers as the other surface layer are laminated, a cleaning sheet which has excellent shape stability and which can efficiently apply the release agent may be obtained. In particular, when the low shrinkable fibers are aromatic polyamide fibers, it is possible to separate the function of the surface layer containing 30% by weight or more of the softening fibers to apply the release agent and the function of the surface layer containing 30% by weight or more of the aromatic polyamide fibers to wipe the toner, and thus efficient applying of the release agent and wiping of the toner may be carried out when the both sides are brought into contact with the fuser roll as mentioned below. When 3 or more fiber webs are laminated, the layer containing 30% by weight or more of the softening fibers may be at any position, but preferably forms one surface layer for applying property of the release agent. Further, the layer containing 30% by weight or more of the low shrinkable fibers may also be at any position. When the low shrinkable fibers are aromatic polyamide fibers, and the both sides of the cleaning sheet are brought into contact with the fuser roll, the layer containing 30% by weight or more of the low shrinkable fibers forms preferably the other surface layer.

As mentioned above, the constituent fibers of the cleaning sheet have an average fiber diameter of 14 μm or less. When two fiber webs are laminated, for example, it is preferable to use two fiber webs having different average fiber diameters, because the fiber web having smaller average fiber diameters can hold the release agent more than the other fiber web, and more sufficient amount of the release agent can be applied to the fuser roll if the fiber web having smaller average fiber diameters is brought into contact with the fuser roll. Thus, if the layer of the fiber web having the smaller average fiber diameter is the layer containing 30% by weight or more of the softening fibers, the release agent may be efficiently applied.

Further, when two fiber webs are laminated, for example, a cleaning sheet having density difference may be obtained by bonding with the adhesive fibers two fiber webs having different blending proportions in the adhesive fibers and the softening fibers. The release agent is more easily held in the layer having higher density. Thus, it is preferable to bring the layer having higher density into contact with the fuser roll because the release agent may be applied in a larger amount. Consequently, if the surface layer having the higher density is a layer containing 30% by weight or more of the softening fibers, the release agent may be applied in a larger amount. Accordingly, the layer having the smaller average fiber diameter and higher density is most preferably the layer containing 30% by weight or more of the softening fibers. The cleaning sheet having different densities may be prepared from when a single fiber web is used, for example, using calender rolls with different hardness or the calender rolls having different temperatures. If the layer having the higher density is brought into contact with the fuser roll, the release agent may be applied at a larger amount.

After the fiber web is formed, the fiber web is bonded with the adhesive fibers. It is preferable, however, to entangle the fiber web, by needle punching or hydroentangling, before bonding, because the fibers are entangled in a denser condition, the degree of freedom of the fibers is lowered, the web becomes hard to be shrinked, and the cleaning sheet having finer pores may be obtained. Particularly, if the mechanically dividable fibers are contained as the softening fibers, such entangling is a preferable preliminary treatment to produce divided ultrafine fibers at the same time.

When the bonding is carried out throughout the web, the cleaning sheet having high density, low degree of freedom of the fibers and low shrinking property may be obtained. The bonding may be carried out, for example, by passing the web through heated calender rolls, or using a flat-press machine, but the former method is preferred because it is more suitable for continuous production. The treatment for passing through calender rolls may be carried out preferably at 170°–250° C. under a linear pressure of 10–100 kg/cm, more preferably at 190°–230° C. under a linear pressure of 30–70 kg/cm, so as to ensure sufficient bonding and uniform thickness. The cleaning sheet having the density difference as mentioned above may be prepared, using a combination of a steel roll and a cotton roll, or rolls having a temperature difference of about 20° C. or more.

The thickness of the cleaning sheet obtained in the above processes is preferably 20–120 μm. If the thickness is less than 20 μm, the fine pores capable of holding the release agent and toner are reduced. If the thickness is more than 120 μm, fine pores which do not contribute to holding the release agent and toner are contained, and thus efficiency is lowered. The thickness is more preferably 40 μm to 90 μm. The weight per unit area of the cleaning sheet is preferably between 10 and 60 g/m$^2$, so long as the strength is maintained and the fine pores are not reduced. The apparent density is preferably 0.25–0.7 g/cm$^3$, more preferably 0.3–0.6 g/cm$^3$, so as to maintain strength during use of the cleaning sheet and excellent holding property of the release agent.

The cleaning sheet of the present invention containing the release agent which can more efficiently remove the toner may be prepared by impregnating, spraying or coating. The release agents which may be used are, for example, silicone oil, such as methyl silicone oil, dimethyl silicone oil, ethyl silicone oil, phenyl silicone oil, amino-modified silicone oil, epoxy-modified silicone oil and 3,3,3-trifluoropropyl silicone oil. Of the silicone oil, dimethyl silicone oil is preferable because of excellent removability of the toner, and 3,3,3-trifluoropropyl silicone oil is preferable because of low surface tension and excellent diffusing property on the surface of the fuser roll. Although the amount of the release agent contained in the cleaning sheet varies with the thickness of the cleaning sheet, it is preferably 5 to 100 g/cm$^2$, because the release agent may be sufficiently applied on the fuser roll. The viscosity of the release agent is preferably 100 to 60,000 centistokes, because the release agent may be thoroughly diffused on the fuser roll, and exhibit the sufficient removability.

The cleaning member of the present invention is designed so that the above-mentioned cleaning sheet containing the release agent is wound around the supply shaft and the other end of the cleaning sheet is fixed to the take-up shaft. Thus, according to the cleaning member of the present invention, a fresh cleaning sheet may be always brought into contact with the fuser roll by continuously supplying the cleaning sheet from the supply shaft. Therefore, the cleaning member of the present invention has excellent applying property of the release agent and excellent removability of the toner. Because the average fiber diameter of the constituent fibers of the cleaning sheet is 14 μm or less, and the fiber diameter of the adhesive fibers used for bonding the constituent fibers, the cleaning member can uniformly hold the release agent, and can wind off the cleaning sheet from the supply shaft while holding the release agent under the condition similar to the one that the release agent is held in the cleaning sheet wound around the supply shaft. Therefore, the release agent can be stabilized to apply by the cleaning member of the present invention, and is hard to be dropped when the amount of the cleaning sheet wound around the supply shaft is reduced. When the cleaning sheet is pressed against the fuser roll, the softening fibers are softened and deformed to reduce the thickness of the cleaning sheet and squeeze the release agent. Therefore, the release agent may be sufficiently applied by the cleaning member of the present invention.

When the cleaning sheet is a laminate of two fiber webs, it is preferable to wind it around the supply shaft so that the surface layer having larger holding capacity of the release agent becomes an inner layer on the supply shaft, because the cleaning sheet can be wound off from the supply shaft under the condition similar to the one that the release agent is held in the cleaning sheet wound around the supply shaft. In other words, it is preferable to wind the cleaning sheet around the supply shaft so that the surface layer having smaller average fiber diameter or the surface layer having higher density becomes an inner layer on the supply shaft.

One of the cleaning apparatus for a fuser roll of the present invention contains the mechanism that the cleaning sheet is wound off from the supply shaft, pressed to the fuser roll, and then wound up around the take-up shaft. The cleaning apparatus will be explained along FIG. 1. The cleaning sheet 1 containing the release agent is wound off from the supply shaft 2, and pressed to the fuser roll 5 by the pinch member 4. The softening fibers in the cleaning sheet 1 is softened and deformed by the heat of the fuser roll 5 and the pressure of the pinch member 4. The release agent is squeezed, and thus, is efficiently applied on the fuser roll. The area of the cleaning sheet 1 contacting with the fuser roll 5 is widened, and thus the cleaning sheet 1 exhibits excellent removability of the toner. Thereafter, the cleaning sheet 1 is wound up around the take-up shaft 3. When the heat-resistance is required for the cleaning sheet which contains the surface layer containing the aromatic polyamide fibers, it is preferable to bring the surface layer into contact with the fuser roll.

In the present invention, it is preferable to bring the surface of the cleaning sheet having better applicability of the release agent into contact with the fuser roll so as to obtain better applicability of the release agent. For example, when the cleaning sheet is formed from two layers, one of which is the surface layer containing 30% by weight or more of the softening fibers, the cleaning sheet is wound off so that the surface layer containing 30% by weight or more of the softening fibers is brought into contact with the fuser roll. For example, when the cleaning sheet is formed from three layers, one of which is the inner layer containing 30% by weight or more of the softening fibers, the cleaning sheet is wound off so that the surface layer having higher transferability of the release agent is brought into contact with the fuser roll.

The surface layer having higher transferability of the release agent may be determined by the following method. Two samples are prepared by cutting the cleaning sheet containing the release agent to a predetermined size (for example, A4 size). Each of the samples is put between two sheets of paper which can entirely cover the sample. The sandwiched sample is passed through the rolls at 50° C. under the pressure of 0.1 kg/cm$^2$. One sample is passed so that one surface (for example, surface A) is turned upward, whereas the other sample is passed so that the other surface (for example, the surface opposite to the surface A) is turned upward. The surface layer which contacts with the sheet of paper which shows the increase of the weight more than the other sheet of paper may be determined to be the surface layer having higher transferability of the release agent.

Figure 2:
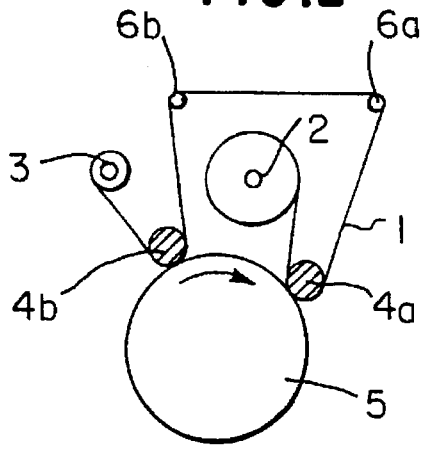
FIG. 2 is a sectional view schematically illustrating another example of a cleaning apparatus.
Figure 3:
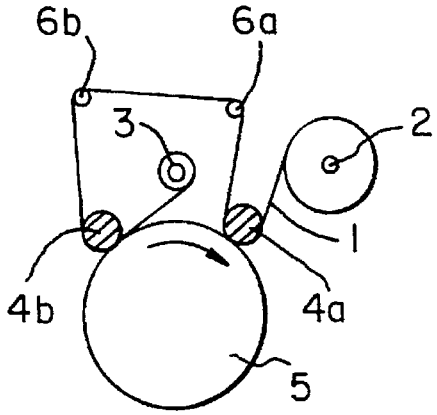
FIG. 3 is a sectional view schematically illustrating still another example of a cleaning apparatus.
Figure 4:
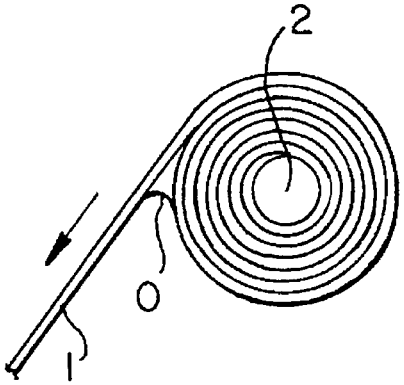
FIG. 4 is an enlarged sectional view schematically illustrating a portion of the cleaning sheet wound off from the supply shaft.

Another cleaning apparatus for a fuser roll of the present invention contains the mechanism that the cleaning sheet is wound off from the supply shaft, pressed to the fuser roll by a first pinch member, reversed from a contacted side to a fresh side, pressed to the fuser roll by a second pinch member, and then wound up around the take-up shaft. The cleaning sheet is brought into contact with the fuser roll twice, and thus the release agent can be applied in a larger amount, and the toner can be removed more efficiently. The cleaning apparatus will be explained along FIGS. 2 and 3. The cleaning sheet 1 containing the release agent is wound off from the supply shaft 2, and pressed to the fuser roll 5 by the first pinch member **4*a*. The softening fibers in the cleaning sheet 1 is softened and deformed by the heat of the fuser roll 5 and the pressure of the pinch member 4*a*. The release agent is squeezed, and thus, is efficiently applied on the fuser roll. The area of the cleaning sheet 1 contacting the fuser roll 5 is widened, and thus the cleaning sheet 1 exhibits excellent removability of the toner. Then, the cleaning sheet 1 is reversed bypassing through the guiding rolls 6*a*, 6*b*, and the surface opposite to the surface once contacted by the fuser roll 5 is brough into contact with the fuser roll 5 by the second pinch member 4*b*. The release agent is applied, and the toner is removed again. Thereafter, the cleaning sheet 1 is wound up around the take-up shaft 3**.

When the both sides of the cleaning sheet containing a surface layer with 30% by weight of the aromatic polyamide fibers are brought into contact with the fuser roll, the applying of the release agent may be mainly carried out at the first contact, and removing the toner may be mainly carried out at the second contact. Thus, the applying of the release agent and removing the toner may be efficiently carried out. It is preferable to carry out the second contact at the upstream portion of the fuser roll, and the first contact at the downstream portion of the fuser roll, because the release agent is not contaminated at the first contact, and thus the release agent used at the second contact is clean.

The cross-sectional shape of the pinch member for the cleaning sheet may be a circular shape or a polygonal shape such as a square or hexagon shape. The circular shape is preferable, because the pressure may be uniformly applied. The pressure of the pinch member is preferably 0.1 kg/cm$^2$ or more, because the cleaning sheet is easily softened and deformed to squeeze the release agent. On the contrary, the pressure of the pinch member is preferably 0.2 kg/cm$^2$ or less, because the fuser roll is not damaged. The pinch member is preferably made of a material having excellent elasticity and heat resistance, such as expanded or non-expanded silicone rubber.

EXAMPLES

The present invention will now be further illustrated by, but is by no means limited to, the following examples:

Example 1

Undrawn polyethylene terephthalate fibers (fiber diameter=18.9 μm; fineness=3.5 denier; fiber length=38 mm; cross-sectional shape=circle: 40% by weight) as the adhesive fibers, drawn polyethylene terephthalate fibers (softening point=240° C.; fiber diameter=12.4 μm; fineness=1.5 denier; fiber length=38 mm; cross-sectional shape=circle: 30% by weight) as the softening fibers, meta-type aromatic polyamide fibers (shrinking rate=0.5%; fiber diameter=12.4 μm; fineness=1.5 denier; fiber length=38 mm; cross-sectional shape=circle: 10% by weight) as the low shrinkable fibers, and meta-type aromatic polyamide fibers (shrinking rate=0.5%; fiber diameter=8.5 μm; fineness=0.7 denier; fiber length=38 mm; cross-sectional shape=circle: 20% by weight) were mixed and opened by a carding machine to obtain parallel fiber web (average fiber diameter=11.8 μm). The fiber web was passed through a steel roll at 210° C. and a cotton roll under a linear pressure of 40 kg/cm to bond the web with the adhesive fibers to obtain a nonwoven fabric (weight per unit area=26 g/cm$^2$; thickness=65 μm; apparent density=0.4 g/cm$^3$). The nonwoven fabric was impregnated with dimethylsilicone oil (viscosity=10,000 centistokes) at 30 g/m$^2$ to obtain the cleaning sheet.

Example 2

The procedure of Example 1 was repeated to obtain a nonwoven fabric (weight per unit area=26 g/cm$^2$; thickness=65 μm; apparent density=0.4 g/cm$^3$; average fiber diameter=11.8 μm), except that undrawn polyethylene terephthalate fibers (fiber diameter=18.9 μm; fineness=3.5 denier; fiber length=38 mm; cross-sectional shape=circle: 40% by weight) as the adhesive fibers, drawn polyethylene terephthalate fibers (softening point=240° C.; fiber diameter=12.4 μm; fineness=1.5 denier; fiber length=38 mm; cross-sectional shape=circle: 40% by weight) as the softening fibers, and meta-type aromatic polyamide fibers (shrinking rate=0.5%; fiber diameter=8.5 μm; fineness=0.7 denier; fiber length=38 mm; cross-sectional shape=circle: 20% by weight) as the low shrinkable fibers were mixed. The nonwoven fabric was impregnated with dimethylsilicone oil at 30 g/m$^2$ to obtain the cleaning sheet.

Example 3

The procedure of Example 2 was repeated to obtain a nonwoven fabric (weight per unit area=26 g/cm$^2$; thickness=65 μm; apparent density=0.4 g/cm$^3$; average fiber diameter=11.3 μm), except that drawn polyethylene terephthalate fibers (softening point=240° C.; fiber diameter=11.1 μm; fineness=1.2 denier; fiber length=38 mm; cross-sectional shape=circle: 40% by weight) as the softening fibers was used. The nonwoven fabric was impregnated with dimethylsilicone oil at 30 g/m$^2$ to obtain the cleaning sheet.

Example 4

Undrawn polyethylene terephthalate fibers (fiber diameter=18.9 μm; fineness=3.5 denier; fiber length=38 mm; cross-sectional shape=circle: 40% by weight) as the adhesive fibers, drawn polyethylene terephthalate fibers (softening point=240° C.; fiber diameter=12.4 μm; fineness=1.5 denier; fiber length=38 mm; cross-sectional shape=circle: 30% by weight) as the softening fibers, and meta-type aromatic polyamide fibers (shrinking rate=0.5%; fiber diameter=9.1 μm; fineness=0.8 denier; fiber length=38 mm; cross-sectional shape=circle: 30% by weight) as the low shrinkable fibers were mixed and opened by a carding machine to obtain parallel fiber web (average fiber diameter=11.6 μm). The resulting web was treated by a cross-layer to obtain the cross-laid web against the web direction.

Further, undrawn polyethylene terephthalate fibers (fiber diameter=18.9 μm; fineness=3.5 denier; fiber length=38 mm; cross-sectional shape=circle: 35% by weight) as the adhesive fibers, and drawn polyethylene terephthalate fibers (softening point=240° C.; fiber diameter=10.1 μm; fineness=1 denier; fiber length=38 mm; cross-sectional shape=circle: 65% by weight) as the softening fibers were mixed and opened by a carding machine to obtain parallel fiber web (average fiber diameter=11.3 μm).

The resulting parallel fiber web and the cross-laid web (3:7, w/w) were laminated, and the whole was passed through a steel roll at 210° C. and a cotton roll under a linear pressure of 40 kg/cm to bond the webs with the adhesive fibers to obtain a nonwoven fabric (weight per unit area=26 g/cm$^2$; thickness=65 μm; apparent density=0.4 g/cm$^3$; average fiber diameter=11.5 μm). The laminated web was passed through the rolls so that the parallel fiber web was contacted by the steel roll. The nonwoven fabric was impregnated with dimethylsilicone oil (viscosity=10,000 centistokes) at 30 g/m$^2$ to obtain the cleaning sheet.

Comparative Example 1

The procedure of Example 1 was repeated to obtain a nonwoven fabric (weight per unit area=26 g/cm$^2$; thickness=65 μm; apparent density=0.4 g/cm$^3$; average fiber diameter=14.1 μm), except that undrawn polyethylene terephthalate fibers (fiber diameter=22.6 μm; fineness=5 denier; fiber length=38 mm; cross-sectional shape=circle: 40% by weight) as the adhesive fibers, and meta-type aromatic polyamide fibers (shrinking rate=0.5%; fiber diameter=12.4 μm; fineness=1.5 denier; fiber length=38 mm; cross-sectional shape=circle: 60% by weight) as the low shrinkable fibers were mixed. The nonwoven fabric was impregnated with dimethylsilicone oil at 30 g/m$^2$ to obtain the cleaning sheet.

Comparative Example 2

The procedure of Example 1 was repeated to obtain a nonwoven fabric (weight per unit area=26 g/cm$^2$; thickness=65 μm; apparent density=0.4 g/cm$^3$; average fiber diameter=12.9 μm), except that undrawn polyethylene terephthalate fibers (fiber diameter=22.6 μm; fineness=5 denier; fiber length=38 mm; cross-sectional shape=circle: 40% by weight) as the adhesive fibers, and meta-type aromatic polyamide fibers (shrinking rate=0.5%; fiber diameter=11.3 μm; fineness=1.25 denier; fiber length=38 mm; cross-sectional shape=circle: 60% by weight) as the low shrinkable fibers were mixed. The nonwoven fabric was impregnated with dimethylsilicone oil at 30 g/m$^2$ to obtain the cleaning sheet.

Comparative Example 3

The procedure of Example 1 was repeated to obtain a nonwoven fabric (weight per unit area=26 g/cm$^2$; thickness=65 μm; apparent density=0.4 g/cm$^3$; average fiber diameter=13.3 μm), except that undrawn polyethylene terephthalate fibers (fiber diameter=18.9 μm; fineness=3.5 denier; fiber length=38 mm; cross-sectional shape=circle: 40% by weight) as the adhesive fibers, meta-type aromatic polyamide fibers (shrinking rate=0.5%; fiber diameter=12.4 μm; fineness=1.5 denier; fiber length=38 mm; cross-sectional shape=circle: 30% by weight) as the low shrinkable fibers, and meta-type aromatic polyamide fibers (shrinking rate=0.5%; fiber diameter=11.3 μm; fineness=1.25 denier; fiber length=38 mm; cross-sectional shape=circle: 30% by weight) were mixed. The nonwoven fabric was impregnated with dimethylsilicone oil at 30 g/m$^2$ to obtain the cleaning sheet.

Comparative Example 4

The procedure of Example 1 was repeated to obtain a nonwoven fabric (weight per unit area=26 g/cm$^2$; thickness=65 μm; apparent density=0.4 g/cm$^3$; average fiber diameter=11.8 μm), except that undrawn polyethylene terephthalate fibers (fiber diameter=18.9 μm; fineness=3.5 denier; fiber length=38 mm; cross-sectional shape=circle: 40% by weight) as the adhesive fibers, meta-type aromatic polyamide fibers (shrinking rate=0.5%; fiber diameter=12.4 μm; fineness=1.5 denier; fiber length=38 mm; cross-sectional shape=circle: 40% by weight) as the low shrinkable fibers, and meta-type aromatic polyamide fibers (shrinking rate=0.5%; fiber diameter=8.5 μm; fineness=0.7 denier; fiber length=38 mm; cross-sectional shape=circle: 20% by weight) were mixed. The nonwoven fabric was impregnated with dimethylsilicone oil at 30 g/m$^2$ to obtain the cleaning sheet.

Comparative Example 5

The procedure of Example 1 was repeated to obtain a nonwoven fabric (weight per unit area=26 g/cm$^2$; thickness=

65 μm; apparent density=0.4 g/cm$^3$; average fiber diameter=11.8 μm), except that undrawn polyethylene terephthalate fibers (fiber diameter=18.9 μm; fineness=3.5 denier; fiber length=38 mm; cross-sectional shape=circle: 40% by weight) as the adhesive fibers, drawn polyethylene terephthalate fibers (softening point=240° C.; fiber diameter=12.4 μm; fineness=1.5 denier; fiber length=38 mm; cross-sectional shape=circle: 20% by weight) as the softening fibers, meta-type aromatic polyamide fibers (shrinking rate=0.5%; fiber diameter=12.4 μm; fineness=1.5 denier; fiber length=38 mm; cross-sectional shape=circle: 20% by weight) as the low shrinkable fibers, and meta-type aromatic polyamide fibers (shrinking rate=0.5%; fiber diameter=8.5 m; fineness=0.7 denier; fiber length=38 mm; cross-sectional shape=circle: 20% by weight) were mixed. The nonwoven fabric was impregnated with dimethylsilicone oil at 30 g/m$^2$ to obtain the cleaning sheet.

Evaluation as to Applicability of Release Agent

The cleaning sheets prepared in Examples 1 to 4 and Comparative Examples 1 to 5 were wound around the aluminum shaft (supply shaft), respectively, and the other end of the cleaning sheet was fixed on the other aluminum shaft (take-up shaft) to obtain the cleaning members. The cleaning sheets prepared in Examples 1 to 3 and Comparative Examples 1 to 5 were wound around the aluminum shaft (supply shaft) so that the surface contacted by the steel roll became an inner layer. The cleaning sheet prepared in Example 4 was wound around the aluminum shaft (supply shaft) so that the surface of the fiber web containing 65% by weight of the softening fibers and having the average fiber diameter of 11.3 μm became an inner layer.

The cleaning sheets prepared in Examples 1 to 4 and Comparative Examples 1 to 5 were wound off from the supply shaft at a rate of 0.15 mm/second were brought into contact with the fuser roll (diameter=32 mm; surface temperature=190° C.; rotating rate=85 rotations/minute) by an expanded silicone pressing roll (diameter=20 mm; cross-sectional shape=circle) under the pressure of 0.1 kg/cm$^2$. Thereafter, the cleaning sheets were wound up. The cleaning sheets were wound off in the direction opposite to the rotating direction of the fuser roll. The surface contacted by the steel roll was brought into contact with the fuser roll, in the case of the cleaning sheets prepared in Examples 1 to 3 and Comparative Examples 1 to 5. The surface of the fiber web containing 65% by weight of the softening fibers and having the average fiber diameter of 11.3 μm was brought into contact with the fuser roll, in the case of the cleaning sheet prepared in Example 4 [shown as "Example 4(1)" in Tables 2 and 3]. Further, the surface of the fiber web containing 30% by weight of the meta-type aromatic polyamide fibers and having the average fiber diameter of 11.6 μm was brought into contact with the fuser roll, in the case of the cleaning sheet prepared in Example 4 [shown as "Example 4(2)" in Tables 2 and 3].

Heat-resistant felts (weight per unit area=900 g/m$^2$; thickness=5 mm; width=2 cm; length=32 cm) were pressed to the fuser roll in order to remove dimethylsilicone oil which had been applied from the cleaning sheets by pressing the cleaning sheets to the fuser roll. The heat-resistant felt was changed to a fresh one every two hours. The amount of dimethylsilicone oil applied from every 3 m length of the cleaning sheet wound off from the supply shaft was calculated from the weight increase of the heat-resistant felt. The amount of dimethylsilicone oil retained in every 3 m length of the cleaning sheet wound around on the take-up shaft was measured by extracting with perchloroethylene dimethylsilicone oil retained in the cleaning sheet. The amount of the retained oil was found to be almost constant in each cleaning sheet wound around on the supply shaft. Therefore, the amount of the oil contained in the cleaning sheet wound off from the supply shaft was evaluated from the above-mentioned amount of the oil applied to the fuser roll from the cleaning sheet. The draining of the oil was visually observed. The results are shown in Tables 1 to 3. It is apparent that a large amount of oil can be stably applied by the cleaning sheet of the present invention, and no draining of the oil was observed in the cleaning sheet of the present invention.

TABLE 1

| | Diameter of adhesive fiber (μm) | Cleaning sheet Contents of softening fiber (%) | Average diameter of fibers (μm) |
|---|---|---|---|
| Example 1 | 18.9 | 30 | 11.8 |
| Example 2 | 18.9 | 40 | 11.8 |
| Example 3 | 18.9 | 40 | 11.3 |
| Example 4 | 18.9 | 30 + 65 | 11.5 |
| Comparative Example 1 | 22.6 | — | 14.1 |
| Comparative Example 2 | 22.6 | — | 12.9 |
| Comparative Example 3 | 18.9 | — | 13.3 |
| Comparative Example 4 | 18.9 | — | 11.8 |
| Comparative Example 5 | 18.9 | 20 | 11.8 |

TABLE 2

| | Amounts of oil applied (g/m$^2$) | | | | |
|---|---|---|---|---|---|
| | 0–3 m | 3–6 m | 6–9 m | 9–12 m | 12–15 m |
| Example 1 | 6.4 | 7.0 | 8.0 | 9.5 | 10.0 |
| Example 2 | 7.3 | 8.1 | 9.4 | 9.9 | 10.8 |
| Example 3 | 7.2 | 8.0 | 8.5 | 9.2 | 9.8 |
| Example 4 (1) | 9.3 | 9.9 | 10.4 | 11.0 | 11.8 |
| Example 4 (2) | 9.0 | 9.5 | 10.0 | 10.5 | 11.3 |
| Comparative Example 1 | 3.0 | 4.5 | 6.4 | 10.0 | 13.7 |
| Comparative Example 2 | 3.9 | 5.5 | 7.1 | 8.6 | 10.2 |
| Comparative Example 3 | 4.9 | 6.0 | 6.9 | 7.8 | 8.9 |
| Comparative Example 4 | 5.1 | 5.9 | 6.7 | 7.5 | 8.5 |
| Comparative Example 5 | 5.4 | 6.3 | 7.3 | 8.0 | 9.1 |

TABLE 3

| | Average amount of oil applied (g/m$^2$) | Standard deviation | Oil drain |
|---|---|---|---|
| Example 1 | 8.2 | 1.4 | No |
| Example 2 | 9.1 | 1.3 | No |
| Example 3 | 8.5 | 0.9 | No |
| Example 4 (1) | 10.5 | 0.9 | No |
| Example 4 (2) | 10.1 | 0.8 | No |
| Comparative Example 1 | 7.5 | 3.9 | draining |
| Comparative Example 2 | 7.1 | 2.2 | Slightly draining |
| Comparative Example 3 | 6.9 | 1.4 | No |
| Comparative Example 4 | 6.7 | 1.2 | No |
| Comparative Example 5 | 7.2 | 1.3 | No |

Although the present invention has been described with reference to specific embodiments, various changes and modifications obvious to those skilled in the art are deemed to be within the spirit, scope, and concept of the present invention.

We claim:

1. A cleaning sheet for a fuser roll, wherein an average diameter of fibers constituting said cleaning sheet is not more than 14 μm; a layer containing not less than 30% by weight of softening fibers which soften at a temperature higher than an ambient temperature of the fuser roll, but lower than a temperature which is 100° C. higher than a surface temperature of said fuser roll is contained; and said cleaning sheet is bonded with adhesive fibers having a fiber diameter of not more than 20 μm.

2. The cleaning sheet according to claim 1, wherein said adhesive fibers contains undrawn polyethylene terephthalate.

3. The cleaning sheet according to claim 1, wherein said softening fibers contains drawn polyethylene terephthalate.

4. The cleaning sheet according to claim 1, which further contains aromatic polyamide fibers.

5. The cleaning sheet according to claim 1, which further contains a surface layer containing not less than 30% by weight of aromatic polyamide fibers.

6. The cleaning sheet according to claim 1, which contains a layer containing not less than 30% by weight of aromatic polyamide fibers, and a layer consisting essentially of the adhesive fibers and the softening fibers.

7. The cleaning sheet according to claim 1, which further contains a release agent.

8. A cleaning member for a fuser roll, comprising the cleaning sheet according to claim 7; a supply shaft around which said cleaning sheet is wound; and a take-up shaft to which one end of said cleaning sheet is fixed.

9. A cleaning apparatus for a fuser roll, comprising the cleaning member according to claim 8; and a pinch member for pressing the cleaning sheet wound off from the supply shaft to the fuser roll and conveying the cleaning sheet to the take-up shaft.

10. A cleaning apparatus for a fuser roll, comprising the cleaning member according to claim 8; a first pinch member for pressing the cleaning sheet wound off from the supply shaft to the fuser roll; a reversing member for turning the cleaning sheet from a contacted side to a fresh side; and a second pinch member for pressing the cleaning sheet from the reversing member to the fuser roll and conveying the cleaning sheet to the take-up shaft.

* * * * *

UNITED STATES PATENT AND TRADEMARK OFFICE

CERTIFICATE OF CORRECTION

PATENT NO. : 5,649,130
DATED : July 15, 1997
INVENTOR(S) : Masahiro Nakajima et al It is certified that error appears in the above-identified patent and that said Letters Patent is hereby corrected as shown below:

In column 15, at line 15, change "contains" to --contain--; and at line 18, change "contains" to --contain--.

Signed and Sealed this

Third Day of February, 1998

*Attest:*

Bruce Lehman

BRUCE LEHMAN

*Attesting Officer*

*Commissioner of Patents and Trademarks*